United States Patent [19]

Suzuki

[11] Patent Number: 4,923,410

[45] Date of Patent: May 8, 1990

[54] LOW-PERMITTIVITY CONNECTOR AND FLAT-CABLE

[75] Inventor: Hirosuke Suzuki, Tokorozawa, Japan

[73] Assignee: Junkosha Co., Ltd., Tokyo, Japan

[21] Appl. No.: 314,147

[22] Filed: Feb. 22, 1989

[30] Foreign Application Priority Data

Feb. 26, 1988 [JP] Japan ..... 63-25295[U]

[51] Int. Cl.[5] ..... H01R 9/07

[52] U.S. Cl. ..... 439/492; 439/499; 439/933

[58] Field of Search ..... 439/465, 467, 492–499, 439/85, 874, 932, 933, 936; 174/117 F, 117 FF, 88 R

[56] References Cited

U.S. PATENT DOCUMENTS

| | | | |
|---|---|---|---|
| 3,605,060 | 9/1971 | Praeger et al. | 439/67 |
| 4,149,026 | 4/1979 | Fritz et al. | 439/117 FF |
| 4,188,714 | 2/1980 | Jean | 439/77 |
| 4,413,028 | 11/1983 | Diaz | 174/88 R |
| 4,443,657 | 4/1984 | Hill et al. | 174/117 FF |
| 4,490,690 | 12/1984 | Suzuki | 174/117 FF |
| 4,639,693 | 1/1987 | Suzuki et al. | 174/117 FF |
| 4,707,671 | 11/1987 | Suzuki et al. | 174/117 FF |
| 4,815,981 | 3/1989 | Mizimo | 439/77 |

*Primary Examiner*—David Pirlot
*Attorney, Agent, or Firm*—Horst M. Kasper

[57] ABSTRACT

A low permittivity connector for providing a plurality of contacts disposed substantially parallel at predetermined spacings relative to each other. Ribbon-type conductors are disposed on a low-permittivity dielectric sheet and exposed on at least one side of the sheet. Wires are contacting respective ribbon-type conductors, disposed in a longitudinal direction relative to the conductors, and projecting as pins from an edge at one end of the low-permittivity dielectric sheet. A housing holds the low-permittivity dielectric sheet, the ribbon-type conductors, and the wires by way of joining sheets and having openings in the area of the ribbon-type conductors at a second end of the low-permittivity sheet for allowing insertion of pins projected from a like connector. A flat cable comprises a plurality of wires formed of a hard cord covered by a conductive layer, plurality of ribbon-type contacts contacting respective wires and a sheet which supports the ribbon-type contacts. Said sheet at least partially covers a surface of the wires. An insulation layer structure covers and holds the plurality of wires, the plurality of ribbon-type contacts, and the sheet, thereby providing support to the wires arranged at a predetermined separation distance relative to each other.

14 Claims, 2 Drawing Sheets

LOW-PERMITTIVITY CONNECTOR AND FLAT-CABLE

BACKGROUND OF THE INVENTION

1. Field of the Invention

This invention relates to a low-permittivity connector and a flat cable for use as a pulse signal transmission path or the like.

2. Brief Description of the Background of the Invention Including Prior Art

As stated in Japanese Patent No. 60-138279 to Jikkaisho, for example, conventional flat cable connectors have been used chiefly as a means of providing electrical line connection. In recent years, it has been getting increasingly necessary for electronic devices to handle microwaves and pulses with a rise time speed in the order of $10^{-12}$ (pico) seconds, requiring connectors to have a controlled characteristic impedance, a high signal transmission speed, a low level of loss, a low level of crosstalk, as in the case of transmission lines such as cables, even though the line length of the connector is very short. No connectors have been available for meeting all these requirements.

SUMMARY OF THE INVENTION

1. Purposes of the Invention

It is an object of the invention to provide a connector capable of transmitting pulses in the microwave band and/or having a rise time speed of about one picosecond.

It is another object of the invention to provide a connector having a controlled characteristic impedance, a low level of loss, and a low level of crosstalk.

It is a further object of the invention to provide a high-speed connector with a structure allowing the use of a flat cable attached to the connector.

These and other objects and advantages of the present invention will become evident from the description which follows.

2. Brief Description of the Invention

The invention connector includes two or more connectors arranged in parallel in predetermined interval spacings on a low-permittivity dielectric sheet with ribbon-type conductors exposed on at least one side of the sheet. Wires are partially contacting said contacts in the longitudinal direction and project in form of pins from one end of the sheet. A housing holds the above structure by means of joining sheets and has openings for said contacts on the other end of the sheet. A flat cable consists of two or more wires, each of which consists of a hard cord covered by an electroconductive layer and an insulation layer which supports the wires arranged in predetermined interval spacings.

A low permittivity connector for providing a plurality of contacts is disposed substantially parallel at predetermined spacings relative to each other. Ribbon-type conductors are disposed on a low-permittivity dielectric sheet and exposed on at least one side of the sheet. Wires are contacting respective ribbon-type conductors, disposed in a longitudinal direction relative to the conductors, and projecting as pins from an edge at one end of the low-permittivity dielectric sheet. A housing holds the low-permittivity dielectric sheet, the ribbon-type conductors, and the wires by way of joining sheets and having openings in the area of the ribbon-type conductors at a second end of the low-permittivity sheet for allowing insertion of pins projected from a like connector.

The ribbon-type conductors can be made of beryllium copper coated or plated with an electricity-conducting material. The low-permittivity dielectric sheet can be formed of stretched porous polytetrafluoroethylene resin. The conductors can be glued to the stretched porous polytetrafluoroethylene resin sheet with a member of the group of glueing layers consisting of ethylene-tetrafluoroethylene resin, fluorinated ethyl-propylene resin, perfluoroalkoxy resin, and mixtures thereof. The pins can be coated annealed copper wire pins.

One of the joining sheets can be corrugated for leaving an air space surrounding the area around the conductor outside of the low-permittivity dielectric sheet. The openings can be tapered inward with a taper angle of from about 2 to 20 degrees.

The dielectric sheet and the joining sheets can be made of an elastic material. An earth wire can be disposed on a side of the dielectric sheet opposite to a side of the dielectric sheet with one of the disposed conductors. A second low-permittivity dielectric sheet can be disposed on the side of the conductors not covered by the first low-permittivity dielectric sheet.

The housing can comprise two joining sheets, each disposed on a side of the low-permittivity dielectric sheet such that the two sides of the low-permittivity dielectric sheet can each be covered by a joining sheet. The average thickness of the joining sheets can be from about 1.5 to 5 times the thickness of the low-permittivity dielectric sheet. The average thickness of the joining sheet can be from about 1.5 to 4 times the average diameter of the openings.

A flat cable according to the invention comprises a plurality of wires formed of a hard cord covered by a conductive layer, a plurality of ribbon-type contacts contacting respective wires, and a sheet which supports the ribbon-type contacts. Said sheet at least partially covers a surface of the wires. An insulation layer structure covers and holds the plurality of wires, the plurality of ribbon-type contacts, and the sheet, thereby providing support to the wires arranged at a predetermined separation distance relative to each other.

According to another aspect of the invention, a flat cable comprises a plurality of wires. Each wire comprises a hard core covered with a conductive layer and an insulation layer structure supporting the wires for holding the wires at a predetermined separation distance relative to each other. The insulation layer structure can be formed by sintered polytetra-fluoroethylene tapes. The insulation layer structure can be formed by a polyester structure.

A flat cable can comprise two or more wires, with each wire consisting of a hard core covered by a conductive layer, ribbon-type contacts in contact with the surface of the wires, a low-permittivity dielectric sheet supporting the ribbon-shaped contacts and covering the surface of the wires, and an insulation layer supporting the wires arranged in predetermined interval spacings. The flat cable can be used for making a connection with or for manufacture of the connector described above.

As set forth above, a low-permittivity connector according to this invention has two or more contacts arranged in parallel of predetermined interval spacings on a porous resin sheet with ribbon-type conductors exposed on at least one side thereof. For this reason, the small dielectric constant (epsilon r) and dielectric loss tangent (tan delta) of the low-permittivity dielectric sheet allow signals to be transmitted through the contacts at a high speed with a small loss. By adjusting the size and relative positions of the ribbon-shaped conductors on the porous resin sheet, it is possible to control the characteristic impedance and thereby reduce the level of crosstalk.

The flat cable of this invention consists of two or more wires, each of which consists of a hard cord covered by an electroconductive layer which is then in turn covered by an insulation layer. By exposing one end of these wires, it is possible to insert them, without losing linearity, into the openings of the connector housing for connection with the contacts and thereby provide direct connection to the connector.

A flat cable comprising wires with ribbon-shaped contacts arranged on a low-permittivity sheet can provide a connection similar to the one discussed above. It is possible to cut the flat cable in a desired length for use as a material for manufacture of the connector discussed above.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
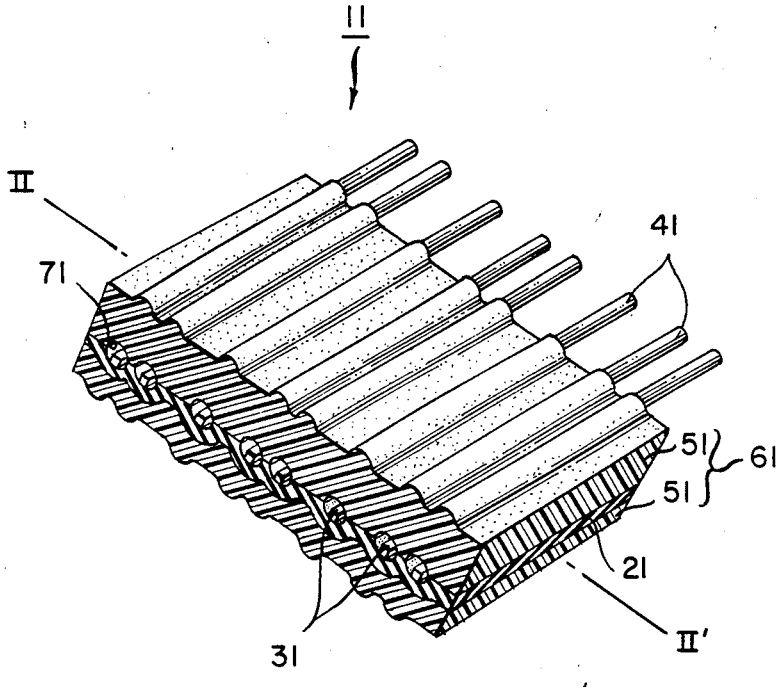
FIG. 1 is a schematic perspective view of a low-permittivity connector made based on this invention.
Figure 2:
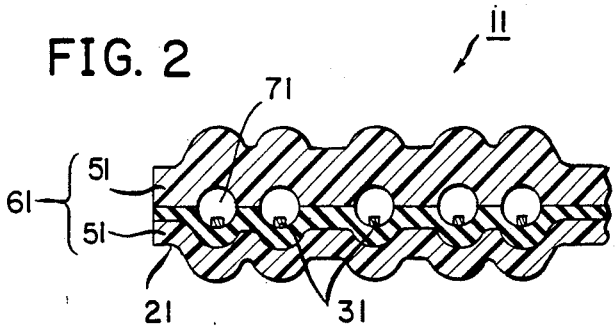
FIG. 2 is a sectional view of a section II-II' of FIG. 1 illustrating part of the connector.
Figure 3:
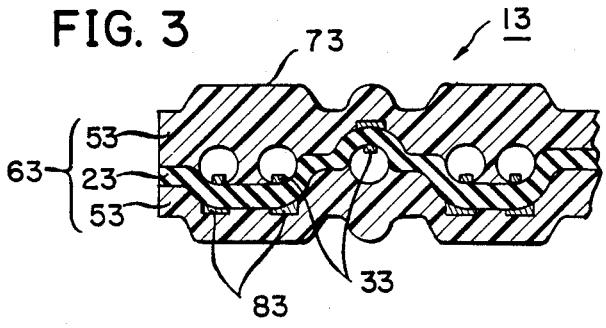
FIG. 3 is a sectional view of a section of a connector of another embodiment of this invention.
Figure 4:
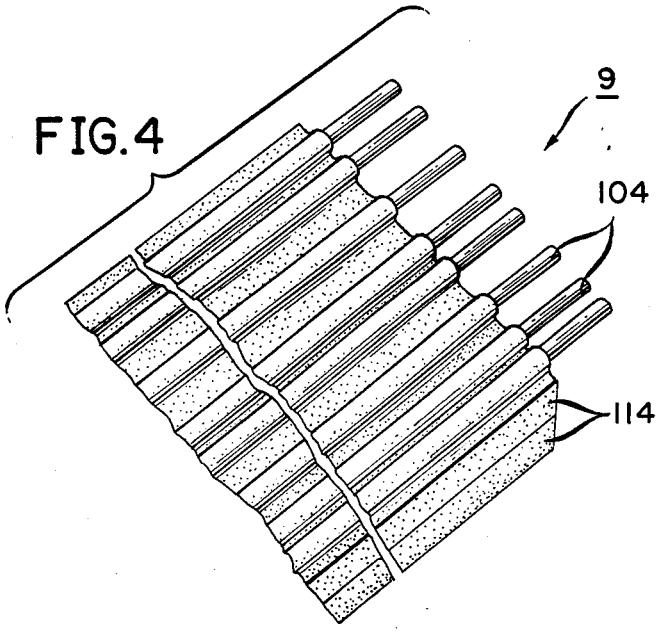
FIG. 4 is a perspective view of a flat cable made based on this invention.

FIGS. 1 to 3 illustrate a low-permittivity connector produced according to this invention in perspective and sectional views. FIG. 4 is a perspective view of a flat cable produced according to this invention.

The low-permittivity dielectric connector 11 shown in FIG. 1 consists of contacts 31 arranged in parallel at predetermined and defined intervals, with ribbon-type conductors of gilded or plated beryllium copper exposed to the outside, which conductors are glued onto one side of a low-permittivity dielectric sheet of stretched porous polytetrafluoroethylene resin (hereinafter referred to as E-PTFE) 21 via a 5 millimicron thick glueing layer of ethylene-tetrafluoroethylene resin (ETFE), fluorinated ethyl propylene resin (FEP) or perfluoroalkoxy resin (PFA), gilded or plated, annealed copper-wire pins 41, which are partially in contact with the contacts 31 (the contacted part not shown in the Figure), and a housing 61 which consists of a pair of corrugated joining sheets 51, 51 of polytetrafluoroethylene (hereinafter referred to as PTFE) and which housing has openings 71 for the contacts 31. The openings 71, into which the wires 104 of the flat cable 9, shown in FIG. 4, are to be inserted, are formed by a pattern of corrugation of the joining sheets 51, 51. The wires 104 are formed such that they can be inserted into the openings 71 and electrically contact the contacts 31.

If the openings 71 are tapered inward, connection will be made easy. In particular, the openings can have a circular sector forming the cross-section of the sheet. If the housing 61 is covered by an additional shield, not illustrated here, it will provide protection against disturbance. If the dielectric sheet 21 and/or the joining sheets 51 are made of elastic material, then the wires to be inserted can be held tightly. It will also be possible to provide an auxiliary means of support for the cable and the connector.

The low-permittivity connector can be manufactured in the same manner as with ordinary flat cables. For example, a continuous flat cable can be made by placing ribbon-type contacts 31 and wire pins 41 on a low-permittivity sheet 21 and placing the resulting structure between corrugated joining sheets 51, 51. A low-permittivity connector 11 can be made by cutting off an appropriate length of the cable and having the wire pins 41 protrude by about half their length. The wire pins 41 are contacting the contacts 31. The wire pins can protrude from the structure of the connector 11 by from about 20 to 70 percent of their total length and preferably by from about 40 to 60 percent of their total length.

It is also possible to make contacts 31 and a low-permittivity dielectric sheet 21 by etching the designated pattern on the copper part of a multi-layer plate, consisting of a beryllium copper sheet and an E-PTFE sheet. FIG. 2 gives a sectional view along the section plane II-II' of FIG. 1 with the same reference numerals assigned to the corresponding parts. FIG. 3 shows another sample connector based on this invention. In this connector, earth wires 83 are placed opposite to contact connectors 33 with a low-permittivity dielectric sheet 23 between them and openings 73 are formed on both sides of the low-permittivity dielectric sheet 23. With this construction, the contact connectors 33, the low-permittivity dielectric sheet 23, and the earth wires 83 form a strip line structure. This makes it possible to control the characteristic impedance by adjusting the widths of the contact connectors 33 and the earth wires 83 and/or the dielectric constant of the low-permittivity sheet 23 and thereby reduce crosstalk to signals to be transmitted through the contact connectors 33. Since the insulation resistance between adjacent conductors can be kept at a high level, a high-density mounting and/or a high-density connector structure will be possible by making the distance between adjacent conductors small. It is an advantageous feature of this invention that high-density connector structures can be obtained. It is also possible to provide openings 73 on both sides of the low-permittivity dielectric sheet 23, if necessary or desired (FIG. 3).

FIG. 4 shows a flat cable to be connected to the low-permittivity connector 11. The cable can be made by arranging wires 104, made of rigid cords gilded or plated with silver, at predetermined interval spacings, placing them between PTFE tapes 114, 114 and then sintering the tapes at 327° C. or more to form an insulation layer structure. Other low-permittivity materials, such as polyester or molded body structures formed of polyester, can also be used to furnish this insulation layer structure.

As described above, the low-permittivity connector based on this invention has contacts 31 arranged in parallel in predetermined interval spacings, with ribbon-type conductors of beryllium copper or the like exposed on at least one side of a low-permittivity dielectric sheet 21 made of E-PTFE or the like. The small dielectric constant (epsilon r) and dielectric loss tangent (tan delta) of the porous resin sheet 21 combine to ensure that signals can be transmitted at a high speed through the contacts 31 with a small level of loss. By adjusting the sizes and relative positioning of ribbon-type conductors on the porous resin dielectric sheet 21, it is possible to obtain a specific characteristic impedance and thereby reduce crosstalk.

The flat cable 9 based on this invention has wires 104, made of rigid copper cords gilded or plated with silver or another metal, which are placed between PTFE tapes 114, 114 for insulation. The wires can be single-element or twisted. The wires can be coated with silver or other materials. The wires 104 can therefore be inserted straight, and without losing linearity, into the openings 71 of the housing 61. Said openings 71 are formed between the corrugated joining sheets 51, 51 of the low-permittivity connector 11, for connection with the contacts 31. Optical fibers, as well as metal cords, can be used for the wires 104 or 41.

As described above, the low-permittivity connector based on this invention has two or more contacts arranged in parallel in predetermined interval spacings on a porous resin low-permittivity dielectric sheet, with ribbon-type conductors exposed on at least one side of the sheet. The small relative dielectric constant (epsilon r: 1.05 to 2.0) and small dielectric loss tangent (tan delta: 0.0005 to 0.01) of the E-PTFE sheet ensures that signals can be transmitted through the contacts at a high speed (60 to 95% of the speed of spatial transmission, or at 60 to 95% of the speed of light in vacuum), with a low level of loss. By adjusting the sizes and relative positioning of the ribbon-type conductors on the E-PTFE sheet, it is possible to control the characteristic impedance and thereby reduce the level of crosstalk. Moreover, it is possible to make low-cost, high-performance connectors of this type by cutting and processing such a flat cable.

The flat cable based on this invention comprises insulated wires made of metal-gilded or metal-plated rigid cords. These wires can be inserted, without losing linearity, into the openings of the housing 61 of the connector, which are disposed between the corrugated joining sheets of the connector, for connecting to the connector. The flat cable can be efficiently connected to the connector without the use of special tools.

This invention is applicable not only to the particular examples set forth above but also to a variety of modifications within the technological concept of this invention. For example, it is possible to use other and/or different materials for the low-permittivity sheet and housing, use highly-rigid plastic bars plated with metal, or electroconductive plastics for the pins, reinforce the housing with a sort of support or with a reinforcing structure, or provide the end of the cables with a support and/or a means to prevent misinsertation.

It will be understood that each of the elements described above, or two or more together, may also find a useful application in other types of connectors and cables differing from the types described above.

While the invention has been illustrated and described as embodied in the context of a low-permittivity connector and flat cable, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A low permittivity connector for providing a plurality of contacts disposed substantially parallel at predetermined spacings relative to each other comprising a low-permittivity dielectric sheet;

ribbon-type conductors disposed on the low-permittivity dielectric sheet and exposed on at least one side of the sheet;

wires contacting respective ribbon-type conductors, disposed in a longitudinal direction relative to the conductors, and projecting as pins from an edge at one end of the low-permittivity dielectric sheet;

a housing holding the low-permittivity dielectric sheet, the ribbon-type conductors, and the wires by way of joining sheets and having openings in the area of the ribbon-type conductors at a second end of the low-permittivity sheet for allowing insertion of wires projecting like pins from a second similar low-permittivity connector.

2. The low-permittivity connector according to claim 1, wherein the ribbon-type conductors are made of beryllium copper coated with an electricity-conducting material.

3. The low-permittivity connector according to claim 1, wherein the pins are conductor metal coated annealed copper wire pins.

4. The low-permittivity connector according to claim 1, wherein one of the joining sheets is corrugated for leaving an air space surrounding the area around the conductor outside of the low-permittivity dielectric sheet.

5. The low-permittivity connector according to claim 1, wherein the openings are tapered inward with a taper angle of from about 2 to 20 degrees.

6. The low-permittivity connector according to claim 1, wherein the dielectric sheet and the joining sheets are made of an elastic material.

7. The low-permittivity connector according to claim 1, further comprising an earth wire disposed on a side of the dielectric sheet opposite to a side of the dielectric sheet with one of the disposed conductors.

8. The low-permittivity connector according to claim 1, further comprising a second low-permittivity dielectric sheet disposed on the side of the conductors not covered by the first low-permittivity dielectric sheet.

9. The low-permittivity connector according to claim 1, wherein the ribbon-type conductors are made of beryllium copper coated with an electricity-conducting material;

wherein the low-permittivity dielectric sheet is formed of

10. The low-permittivity connector according to claim 1, wherein the low-permittivity dielectric sheet is formed of stretched porous polytetrafluoroethylene resin.

11. The low-permittivity connector according to claim 10, wherein the conductors are glued to the stretched porous polytetrafluoroethylene resin sheet with a member of the group of glueing layers consisting of ethylene-tetrafluoroethylene resin, fluorinated ethylpropylene resin, perfluoroalkoxy resin, and mixtures thereof.

12. The low-permittivity connector according to claim 1, wherein the housing comprises two joining sheets, each disposed on a side of the low-permittivity dielectric sheet such that the two sides of the low-permittivity dielectric sheet are each covered by a joining sheet.

13. The low-permittivity connector according to claim 12, wherein the average thickness of the joining sheets is from about 1.5 to 5 times the thickness of the low-permittivity dielectric sheet.

14. The low-permittivity connector according to claim 12, wherein the average thickness of the joining sheet is from about 1.5 to 4 times the average diameter of the openings. stretched porous polytetrafluoroethylene resin;

wherein one of the joining sheets is corrugated for leaving an air space surrounding the area around the conductor outside of the low-permittivity dielectric sheet;

wherein the openings are tapered inward with a taper angle of from about 2 to 20 degrees;

wherein the dielectric sheet and the joining sheets are made of an elastic material;

and comprising an earth wire disposed on a side of the dielectric sheet opposite to an opposed side of the dielectric sheet with one of the disposed conductors; and wherein the housing comprises two joining sheets, each disposed on a side of the low-permittivity dielectric sheet such that the two sides of the low-permittivity dielectric sheet are each covered by a joining sheet;

wherein the average thickness of the joining sheets is from about 1.5 to 5 times the thickness of the low-permittivity dielectric sheet; and wherein the average thickness of the joining sheet is from about 1.5 to 4 times the average diameter of the openings.

* * * * *